United States Patent [19]

Johnson

[11] Patent Number: 4,603,498

[45] Date of Patent: Aug. 5, 1986

[54] EXTERNALLY VISIBLE SAFETY DEVICE FOR GRENADE LAUNCHER

[76] Inventor: David A. Johnson, 3432 Tanglewood Way, Salem, Oreg. 97302

[21] Appl. No.: 784,526

[22] Filed: Oct. 4, 1985

[51] Int. Cl.[4] ..... F41C 17/08; F41F 1/00

[52] U.S. Cl. ..... 42/105; 42/70.11

[58] Field of Search ..... 42/1 F, 1 A, 1 D, 1 LP

[56] References Cited

U.S. PATENT DOCUMENTS

| | | | |
|---|---|---|---|
| 2,997,802 | 8/1961 | Robbins | 42/1 LP |
| 3,089,272 | 5/1963 | McKinlay | 42/1 LP |
| 3,605,311 | 9/1971 | Hermann | 42/1 LP |
| 4,058,923 | 11/1977 | Smith | 42/1 LP |
| 4,136,476 | 1/1979 | Hetrick | 42/1 LP |
| 4,384,420 | 5/1983 | Von Muller | 42/1 LP |
| 4,528,765 | 7/1985 | Johnson | 42/1 LP |

*Primary Examiner*—Charles T. Jordan
*Assistant Examiner*—Michael J. Carone
*Attorney, Agent, or Firm*—Chernoff, Vilhauer, McClung & Stenzel

[57] ABSTRACT

A safety device for firearms, including a chamber plug portion fitting in the breech and preventing insertion of a cartridge, and an indicator located externally of the weapon and fixedly joined with the chamber plug by a connector small enough to fit within a pre-existing passageway extending between the interior of the firing chamber and the exterior of the weapon when the breech of the weapon is closed as if in readiness for firing. Preferably, the indicator is of a bright color and is located so as to be visible on both sides of the weapon.

14 Claims, 5 Drawing Figures

FIG. 1
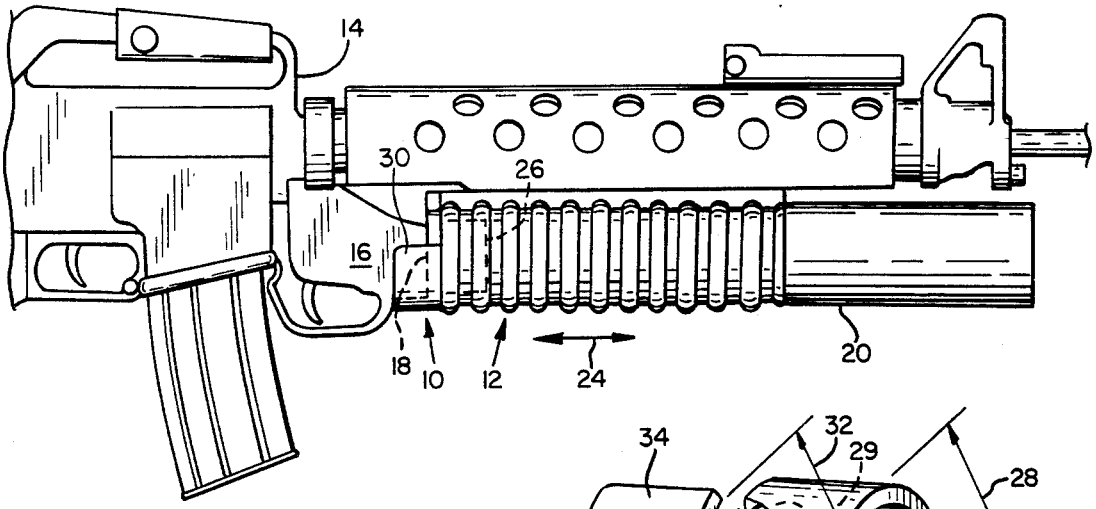
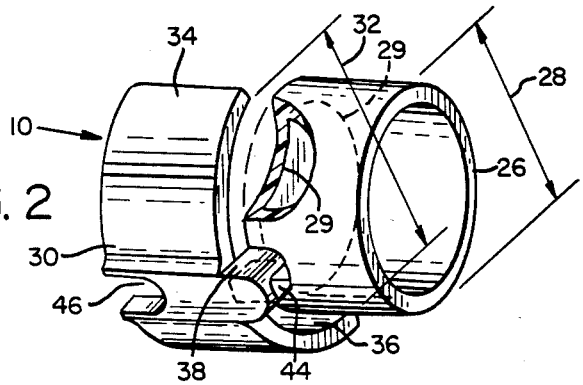
FIG. 2
FIG. 3
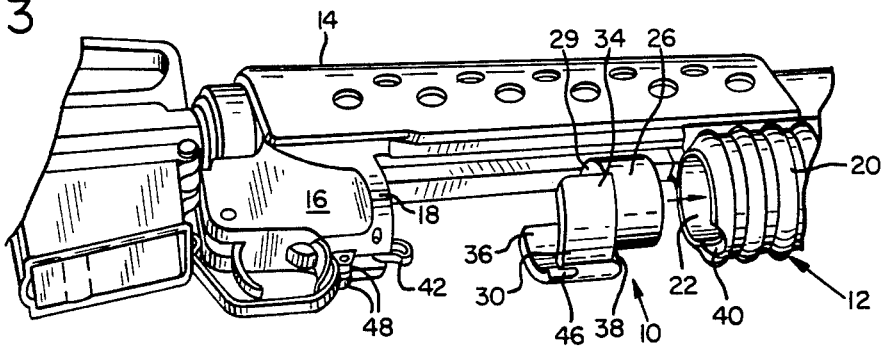
FIG. 4
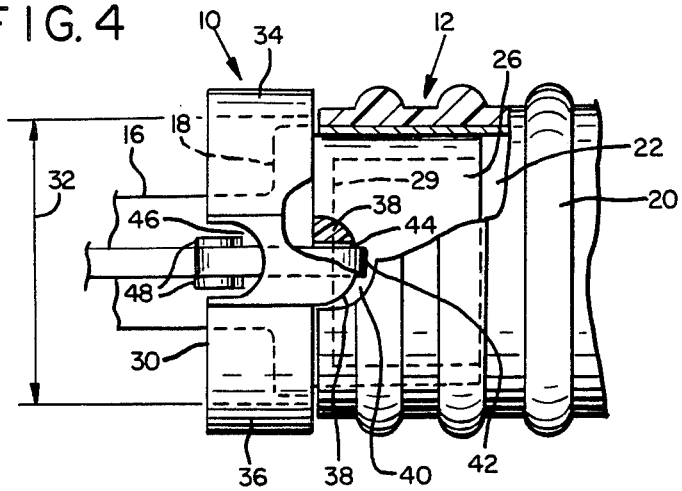
FIG. 5
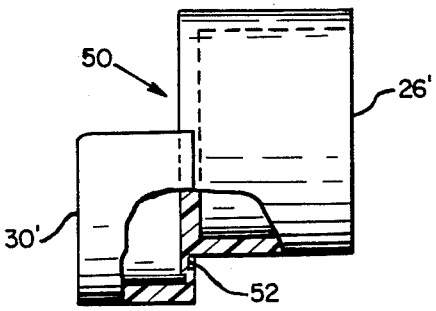

EXTERNALLY VISIBLE SAFETY DEVICE FOR GRENADE LAUNCHER

BACKGROUND OF THE INVENTION

The present invention relates to a safety device for use with a firearm, and particularly to such a safety device which is visible externally and prevents insertion of a cartridge into a firing chamber of a manually breech-loaded firearm, yet permits the action of the firearm to be fully closed while the safety device is present.

Some firearms of the breech-loading single-shot variety, particularly firearms such as the M203 Grenade Launcher which is used with the M-16 rifle of the armed forces of the United States, are somewhat unwieldy when the action is not closed. Additionally, having the breech of such a firearm open exposes both the breech block or equivalent mechanism and the firing chamber to entry of dust and other contaminants which may damage the weapon.

However, in handling firearms it is extremely important that they be in a safe condition, except when about to be intentionally discharged. Particularly when personnel unfamiliar with such weapons are being trained in their use, it is important that the weapons be made impossible to discharge, and it is desirable that such a safe condition be visually verifiable by an instructor from an appreciable distance. Furthermore, such a condition of safety should be attained easily and quickly, without disassembly of the weapon or rendering it permanently unuseable.

Additionally, it is desireable to have such a weapon in a safe condition, yet have the breech of the firing chamber fully closed and locked, in order to exclude contaminants, and to permit weapons to be handled, during training, as if they were ready to be discharged.

Prior efforts to provide a means of making a firearm safe from accidental firing without disassembly of the weapon include a chamber plugging device shown in Robbins U.S. Pat. No. 2,997,802. Robbins discloses a device useable particularly in a bolt action rifle to plug the firing chamber and interfere with closure of the bolt of such a weapon. The Robbins device, however, does not appear to be appropriate for use with certain types of single shot breech-loading weapons, and particularly does not seem suitable for use with grenade launchers, as it requires that the breech be kept open. In a grenade launcher such as the Model M203 Grenade Launcher this would apparently result in a slideable launcher tube portion of the weapon remaining moveable, which is undesirable.

Hermann U.S. Pat. No. 3,605,311 and McKinlay U.S. Pat. No. 3,089,272 disclose devices which may be locked in place in the ejection ports of shotguns to prevent insertion of cartridges and closure of the breech of such weapons. These devices, however, are not readily visible from both sides of a weapon so equipped, and may allow entry of contaminants into the mechanisms of the weapons as a result of the breech being held open.

VonMuller U.S. Pat. No. 4,384,420 discloses a replacement for the magazine of an automatic pistol which may be locked in position to prevent insertion of a loaded magazine. The VonMuller device also seems to be deficient in not being readily visible as a safety indicator from any distance.

Johnson U.S. Pat. No. 4,528,765 discloses an externally visible safety device useable with repeating firearms such as automatic rifles equipped with box-type magazines. The device disclosed in the Johnson patent, however, is not readily adaptable for use in a single shot breech loading weapon such as the M203 Grenade Launcher.

What is needed, then, is a device which will positively prevent a weapon such as a breech loading grenade launcher from being fired accidentally, and which will make it easily verifiable visually, from a considerable distance away from the weapon, that the weapon is incapable of being fired. Such a device ideally should be straightforward, inexpensive, and easy to use, and should make a weapon safe without thereby exposing internal working parts to contamination, and without preventing the weapon from being readied quickly to be fired.

SUMMARY OF THE INVENTION

The present invention overcomes the shortcomings of prior art externally visible safety-indicating devices and meets the need for a device for making breech-loading weapons verifiably safe for non-firing closed-breech use, by providing an inexpensive, simple, and lightweight device including a chamber plug which fits into the breech of the firing chamber of such a weapon and prevents insertion of a cartridge. Combined with the chamber plug is an easily visible indicator which is located outside the weapon, but is connected with the chamber plug by a connector member which extends generally radially between the indicator and the chamber plug. The connector member is small enough to pass through an available passageway from the interior of the breech of the firearm to the outside, allowing the breech of the firing chamber to be closed in the normal manner, in order to exclude contaminants from the interior of the firing chamber.

In a preferred embodiment of the invention a plug fits in the breech of the firing chamber of a single-shot breech-loading weapon such as an M203 Grenade Launcher, and an arcuate indicator located outside the weapon extends rearwardly from the junction of the chamber and the breech block of the weapon, prominently covering a portion of the receiver of such a grenade launcher. A connector portion extends radially downward from the rear edge of the chamber plug through a recess providing room for an extractor, to connect the chamber plug to the indicator. Because the connector includes an aperture large enough to admit the extractor, the breech of the weapon can be fully closed while the safety device is in place preventing insertion of a cartridge into the firing chamber.

Physical support for the indicator is provided by the chamber plug's presence in the firing chamber. Therefore, presence of the indicator, in its easily visible position covering a portion of the receiver, gives a positive indication that the firing chamber is plugged, and that the weapon therefore cannot be fired.

It is therefore, a principal object of the present invention to provide a positively acting safety device by means of which a safe condition of a weapon can be visually verified quickly and positively.

It is another important object of the present invention to provide a safety device for a military weapon which protects the internal mechanisms of such a weapon by permiting the action to be fully closed while the safety device is in place.

It is an important feature of the safety device of the present invention that it includes an indicator which extends along the exterior of both sides of a weapon in which the chamber plug of the device is present, providing an indication, clearly visible from either side of the weapon, that the weapon cannot be fired.

It is another important feature of the safety device of the present invention that the indicator and the chamber plug are interconnected by a connector which is small enough that the breech of a weapon in which the device is used may be fully closed and locked, permitting the weapon to be handled and carried as if it were loaded, but with complete safety.

It is an important advantage of the safety device of the present invention that it makes it possible to verify more easily than was previously possible that a breech-loading weapon with its breech closed is in a safe condition.

It is another important advantage of the safety device of the present invention that it makes it possible to verify that a single-shot breech-loading weapon is in a safe condition from a greater distance than possible without such a device.

The foregoing and other objects, features, and advantages of the present invention will be more readily understood upon consideration of the following detailed description of the invention taken in conjunction with the accompanying drawings.

BRIEF DESCRIPTION OF THE DRAWINGS

FIG. 1 is a side elevational view of a grenade launcher equipped with a safety device embodying the present invention.

FIG. 2 is a perspective view, at an enlarged scale, of the safety device shown in FIG. 1.

FIG. 3 is a perspective view of a part of the grenade launcher shown in FIG. 1, with its breech open, together with the safety device shown in FIG. 1.

FIG. 4 is a partially cutaway view of a portion of the grenade launcher shown in FIG. 1, together with the safety device shown in FIG. 1.

FIG. 5 is a partially cutaway view of a safety device which is an alternative embodiment of the present invention.

DETAILED DESCRIPTION OF THE INVENTION

Referring now to the drawings, in FIG. 1 an exemplary safety device 10 according to the present invention is shown in place on a grenade launcher 12 which may be of the M203 design used by the armed forces of the United States, and which is ordinarily used mounted upon a rifle such as the M-16 rifle 14 shown partially in FIG. 1. The grenade launcher 12 includes a receiver portion 16 whose forward portion includes a breech block 18. A grenade launching tube 20 extends forward from a position adjacent the breech block 18 and includes as its rearmost portion a firing chamber 22 (FIGS. 3 and 4). The launching tube 20 is slidable longitudinally along the frame of the grenade launcher 12, beneath the rifle 14, as indicated by the arrow 24, so that a cartridge may be inserted into the open breech of the firing chamber 22 when the launching tube 20 is in a forward position, spaced apart from the breech block 18. The launching tube must be latched into its rearward position with the breech end of the structure of the firing chamber 22 abutting the breech block 18 in order to discharge a cartridge and thereby launch a grenade from the launching tube 20.

In order to prevent insertion of a cartridge into the firing chamber 22, the safety device 10 of the present invention includes a chamber plug portion 26, shown most clearly in FIG. 2. The chamber plug 26 may be tubular in form to minimize its weight and has a diameter 28 which fits easily within the breech end of the firing chamber 22, blocking entry of a cartridge into the firing chamber 22. A wall 29 may be provided at the rear end of the chamber plug 26 to prevent a cartridge of a smaller diameter from being inserted into the firing chamber 22 within the chamber plug 26.

An indicator portion 30 of the safety device 10 is approximately semicircular, having the form of one half of a short length of tube having an inside diameter 32 which is great enough to surround the lower half of the receiver 16 in the vicinity of the breech block 18, so that respective side portions 34 and 36 of the indicator 30 are easily visible on their respective sides of the grenade launcher 12 when the safety device 10 is in place as shown in FIG. 1.

It will be apparent that other shapes could be used for the indicator 30, the principal object being to provide a strikingly visible indicator of great enough size to be seen at a considerable distance away from the firearm with which the safety device 10 is being used. For example, an indicator might extend forward, surrounding a portion of the launching tube 20, rather than extending rearward and surrounding the breech block 18.

Rigidly interconnecting the chamber plug 26 and the indicator 30 is a connector 38. In the embodiment of the invention shown in FIGS. 1–4, the connector 38 is generally semicylindrical in shape, with its longitudinal axis extending radially, downward, from the bottom rear part of the chamber plug 26 to the bottom forward edge of the indicator 30.

The semicylindrical connector 38 fits within a similarly shaped extractor recess 40 located in the bottom rear edge of the wall of the firing chamber 22, as may be seen in FIGS. 3 and 4. The breech block 18 and the extractor recess 40 together define a passageway communicating between the interior of the firing chamber 22 and the exterior of the firearm.

As shown in FIG. 3, the chamber plug 26 of the invention is placed into the breech end of the firing chamber 22 when the launching tube 20 is in a forwardlydisplaced position. Thereafter, the launching tube 20 is moved rearwardly toward the breech block 18 and latched into place in its breech-closed configuration as shown in FIGS. 1 and 4.

As there is an extractor 42 located on the bottom of the forward face of the breech block 18, an aperture 44 extends longitudinally through the connector 38, permitting the extractor 42 to extend therethrough when the launching tube 20 is latched in its breechclosed fully rearward position as shown in FIG. 1. The aperture 44 and the relative position of the extractor 42, when the grenade launcher is latched closed in its ready-to-fire configuration, are shown somewhat more clearly in FIG. 4, where portions of the grenade launcher 12 are cut away. A portion of the rear edge of the indicator 30 defines an opening at 46 to provide clearance for the downwardly protruding ears 48 which support the trigger guard of the grenade launcher 12.

Referring now also to FIG. 5, a safety device 50 which is an alternative embodiment of the invention is generally similar to the safety device 10, including a short tubular chamber plug portion 26' and a short rearwardly located semicircular indicator portion 30'. However, the safety device 50 differs from the safety device 10 in that the chamber plug 26 is connected with the indicator 30' by a generally radially extending, web-like connector portion 52 which is present in a segment of the circumference of the chamber plug 26'. The web-like connector 52 must be thin enough to fit within a passageway which may be merely the clearance available between the breech end of the wall of the firing chamber and the breech closing element of a weapon with which the safety device 50 is to be used. Nevertheless, the web-like connector 52 must be strong enough to interconnect the chamber plug 26' and the indicator 30' securely, yet thin enough to permit the weapon with which the safety device 50 is to be used to be closed to its normal configuration, in which it would be ready to fire except for the presence of the safety device 50.

The safety devices 10 and 50 may be made of any material which is readily shaped and not likely to damage the grenade launcher, but a preferred material is an easily molded plastic which is suitably sturdy, inexpensive, and able to withstand the temperatures which might be encountered when the safety device is placed into the firing chamber after use of the grenade launcher or other firearm.

The safety device 10 or 50 of the present invention, as has been described hereinabove, is simple to manufacture and easy to use, and permits a firearm to be handled and carried just as if it were loaded, as during training in use of the weapon, although the weapon is perfectly safe because it cannot be loaded as long as the safety device 10 or 50 is in place.

It will be appreciated that the safety device of the invention will also be usable with other firearms of which the breech block and the breech end of the barrel are movable relative to one another but must be in a closed, locked, ready-to-fire configuration for realistic handling during training in their use.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An externally visible safety device for a breech loading firearm having structure defining a firing chamber for receiving a cartridge to be fired and a breech-closing member for selectively closing a breech opening of said firing chamber, said structure defining a firing chamber and said breech-closing member cooperatively defining a passageway communicating in a radial direction between the interior of said firing chamber and the exterior of said firearm when said breech is closed by said breechclosing member, the safety device comprising:

(a) a chamber plug of a size which fits within said firing chamber in a position adjacent the breech thereof, preventing placement of a cartridge into said firing chamber;

(b) an indicator which is located in a position visibly exposed externally of said firearm when said chamber plug is located within said firing chamber; and (c) connector means extending between said chamber plug and said indicator, for connecting said chamber plug with said indicator, said connector means being of a size and shape which fits within said passageway, and said connector means being small enough not to interfere with the closing of the breech of said firing chamber by said breech-closing member.

2. The safety device of claim 1 wherein said firearm includes an extractor associated with said breech-closing member and said passageway includes an extractor recess, said connector means being of a size and shape which fits within said extractor recess, with said connector means extending generally radially therethrough between said firing chamber plug and said indicator when said safety device is located in said firing chamber with said breech thereof closed by said breech-closing member.

3. The safety device of claim 2, said connector means defining an extractor aperture extending thereinto, said aperture being large enough to receive said extractor when said breech-closing member is in a position closing said breech opening of said firing chamber.

4. The safety device of claim 3 wherein said extractor aperture in said connector means extends generally longitudinally of said firearm when said safety device is operatively located therein.

5. The safety device of claim 1 wherein said passageway includes a circumferential gap extending generally radially between said structure defining a firing chamber and said breech-closing member, and wherein said connector means includes a radiallyextending web disposed about a predetermined segment of said chamber plug.

6. The safety device of claim 1 wherein said firearm includes a receiver having respective left and right sides and wherein said indicator extends rearwardly of said chamber plug and is disposed exteriorly adjacent at least a part of each of said left and right sides of the receiver of said firearm.

7. The safety device of claim 1 wherein said indicator is substantially semicircular in shape and includes respective left and right side portions each extending adjacent a respective side of said firearm.

8. The safety device of claim 1 wherein said indicator is of a bright color.

9. The safety device of claim 1 wherein said safety device is of monolithic molded plastic construction.

10. The safety device of claim 1 wherein said connector means extends generally radially ralative to said firing chamber.

11. The safety device of claim 1 wherein said connector means is fixedly attached to said chamber plug and said indicator.

12. The safety device of claim 1 wherein said firearm has a left side and a right side, said indicator including structure located so as to be conspicuously visible on both of said left and right sides of a firearm in which the safety device is installed.

13. In combination with a breech loading firearm including structure defining a firing chamber for receiving a cartridge to be fired, said firing chamber defining a breech opening, and said firearm further including a breech block for selectively closing said breech opening and structure defining a passageway communicating in a radial direction between the interior of said firing chamber and the exterior of said firearm when said breech is closed by said breech block, an externally visible safety device, comprising:

(a) chamber plug means of a size which fits within said firing chamber, for preventing entry of a cartridge into said firing chamber;

(b) an indicator located in a position visibly exposed externally of said firearm; and (c) connector means extending between said chamber plug and said indicator, for connecting said chamber plug with said indicator, said connector means being of a size and shape which fits within said passageway, and being small enough not to interfere with the closing of the breech of said firing chamber structure by said breech block.

14. The safety device of claim 13 wherein said firearm is a grenade launcher and said passageway includes an extractor clearance recess.

* * * * *

UNITED STATES PATENT AND TRADEMARK OFFICE

CERTIFICATE OF CORRECTION

PATENT NO. : 4,603,498

DATED : Aug. 5, 1986

INVENTOR(S) : David A. Johnson

It is certified that error appears in the above-identified patent and that said Letters Patent is hereby corrected as shown below:

| | |
|---|---|
| Col. 4, Line 49 | Change "lydisplaced" to --ly-displaced-- |
| Col. 4, Line 56 | Change "breechclosed" to --breech-closed-- |
| Col. 5, Line 58 | Change "breechclosing" to --breech-closing-- |
| Col. 6, Line 30 | Change "radiallyextending" to --radially-extending-- |

Signed and Sealed this

Sixteenth Day of December, 1986

*Attest:*

DONALD J. QUIGG

*Attesting Officer* *Commissioner of Patents and Trademarks*